US010301068B2

(12) United States Patent
Nottestad et al.

(10) Patent No.: US 10,301,068 B2
(45) Date of Patent: May 28, 2019

(54) RETRACTABLE STOP WITH FRICTIONAL ELEMENT

(71) Applicant: ORBIS Corporation, Oconomowoc, WI (US)

(72) Inventors: Andrea M. Nottestad, Lake Geneva, WI (US); Stephen Roland Howe, Cottage Grove, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 15/276,973

(22) Filed: Sep. 27, 2016

(65) Prior Publication Data

US 2017/0096255 A1 Apr. 6, 2017

Related U.S. Application Data

(60) Provisional application No. 62/235,869, filed on Oct. 1, 2015.

(51) Int. Cl.
*B65D 19/44* (2006.01)

(52) U.S. Cl.
CPC .... *B65D 19/44* (2013.01); *B65D 2519/00034* (2013.01); *B65D 2519/00069* (2013.01); *B65D 2519/00268* (2013.01); *B65D 2519/00338* (2013.01); *B65D 2519/00815* (2013.01)

(58) Field of Classification Search
CPC ..... B65D 19/44; B65D 2519/00815; B65D 19/32; B65D 19/38; B65D 2519/00034; B65D 2519/00069; B65D 2519/00268; B65D 2519/00338; B60R 2011/0071; F16M 2200/08
USPC ..... 248/615, 617, 346.02–346.04, 188, 677, 248/188.8–188.9; 410/83; 108/55.1–55.5, 57.25, 56.3; 193/32; 280/79.11–79.7
See application file for complete search history.

(56) References Cited

U.S. PATENT DOCUMENTS

| | | | | |
|---|---|---|---|---|
| 3,739,894 A | | 6/1973 | Hinman | |
| 4,200,272 A | * | 4/1980 | Godding | B23Q 1/035 269/26 |
| 4,207,655 A | * | 6/1980 | MacMaster | F16B 5/10 292/62 |
| 4,706,793 A | * | 11/1987 | Masciarelli | B65G 47/54 193/35 A |
| 5,153,052 A | * | 10/1992 | Tanaka | A47B 91/06 108/156 |
| 6,129,195 A | * | 10/2000 | Matheny | B65G 13/00 193/35 A |

(Continued)

FOREIGN PATENT DOCUMENTS

| | | |
|---|---|---|
| JP | 1179181 A | 3/1999 |
| WO | 2013159796 A1 | 10/2013 |

OTHER PUBLICATIONS

Russian Patent Office, International Search Report and Written Opinion for PCT/US2016/054068 dated Jan. 12, 2017 (6 pages).

*Primary Examiner* — Christopher Garft
(74) *Attorney, Agent, or Firm* — Greensfelder, Hemker & Gale, P.C.

(57) ABSTRACT

A transport structure, such as a pallet or dolly, having a plurality of retractable stops with frictional elements is provided. The frictional elements are exposed when the retractable stop is in a retracted position.

18 Claims, 4 Drawing Sheets

(56) References Cited

U.S. PATENT DOCUMENTS

| | | | | |
|---|---|---|---|---|
| 6,926,238 | B1 * | 8/2005 | Blessing | B64F 5/50 248/129 |
| 7,123,856 | B2 * | 10/2006 | Marumoto | G03G 15/00 399/107 |
| 7,311,302 | B1 * | 12/2007 | Farlow | H05K 13/0069 269/21 |
| 8,264,839 | B2 * | 9/2012 | Shen | H05K 5/0204 248/188.8 |
| 9,266,463 | B2 * | 2/2016 | Hindy | B60P 7/0892 |
| 2001/0049149 | A1 * | 12/2001 | Kennedy | B01J 19/0046 436/180 |
| 2006/0022100 | A1 * | 2/2006 | Lan | A47G 1/17 248/220.21 |
| 2008/0029664 | A1 * | 2/2008 | Hsu | F16M 7/00 248/188.8 |
| 2010/0095875 | A1 * | 4/2010 | Hailston | B65D 19/0028 108/57.29 |
| 2011/0042118 | A1 * | 2/2011 | Fan | G06F 1/166 174/50 |
| 2013/0032984 | A1 * | 2/2013 | Moncavage | B23Q 1/035 269/296 |

* cited by examiner

RETRACTABLE STOP WITH FRICTIONAL ELEMENT

CROSS-REFERENCE TO RELATED APPLICATIONS

The present application claims the benefit of U.S. Provisional Patent Application No. 62/235,869, filed Oct. 1, 2015, the contents of which are incorporated herein by reference.

FEDERALLY SPONSORED RESEARCH OR DEVELOPMENT

N/A

FIELD OF THE INVENTION

The present invention generally relates to a retractable stop for a pallet or other similar structure having a frictional element on an exposed surface when retracted.

BACKGROUND OF THE INVENTION

Pallets, dollies and other similar structures are used for transporting goods or other articles, typically held in containers. Issues arise if the containers move on the pallet during transportation. Currently, movement of containers during transportation is prevented or limited by hard stops, such as molded (i.e., fixed) perimeter lips and side walls; and/or frictional elements, such as rubber grommets and scuffed or gritty (i.e., rough) surfaces.

In certain instances, retractable stops (typically referred to as "pop-ups") positioned about the pallet or dolly can be used to create hard stops for containing certain size containers. For larger containers, the pop-up is retracted under the weight of the container.

The present invention provides an improved retractable stop that combines the features of a hard stop with those of a frictional element.

SUMMARY OF THE INVENTION

The present invention provides a retractable stop with a frictional element on a top surface of the stop. The combination of a retractable stop with a frictional element provides the flexibility of a pop-up with the added benefit of the frictional surface to prevent movement of various sized containers during transport. In particular, adding the frictional element to the pop-up solves the problem of unwanted movement when large or oversized containers are transported by smaller footprint pallets or dollies. The pop-ups on such smaller pallets or dollies are typically positioned for smaller containers and are in a retracted position when used with larger containers. This is because the larger container is typically positioned on top of one or more of the retractable stops—forcing the stops to retract downward into the pallet. The frictional element inhibits the larger container from moving in such situations.

In accordance with one embodiment of the invention, a transport structure with a combination retractable stop and frictional element is provided. The transport structure comprises a support surface for transporting an item, a first retractable stop mounted to the transport structure and a first frictional element secured to a portion of the first retractable stop. The transport structure can be a pallet, dolly or other similar structure.

The stop can be formed from plastic. The stop includes a first spring element and a second spring element. The spring elements can be leaf springs.

The frictional element can be formed from rubber or cork or other friction generating material. The frictional element can also be provided with a texture, raised and/or lowered pattern, or other surface configurations to increase its ability to prevent slippage of containers.

The first retractable stop can include a first extension portion that extends above the support surface when the retractable stop is not retracted and a base portion. It can also include a depression for receiving the first frictional element. The frictional element can be molded in the retractable stop.

In accordance with another embodiment, a transport item comprises a support surface for transporting items and a plurality of retractable stops positioned about the support surface. Each of the plurality of retractable stops includes a frictional element secured to a portion of the retractable stop.

Further aspects of the invention are disclosed in the Figures and are described herein.

BRIEF DESCRIPTION OF THE DRAWINGS

To understand the present invention, it will now be described by way of example, with reference to the accompanying drawings in which.

DETAILED DESCRIPTION

Figure 1:
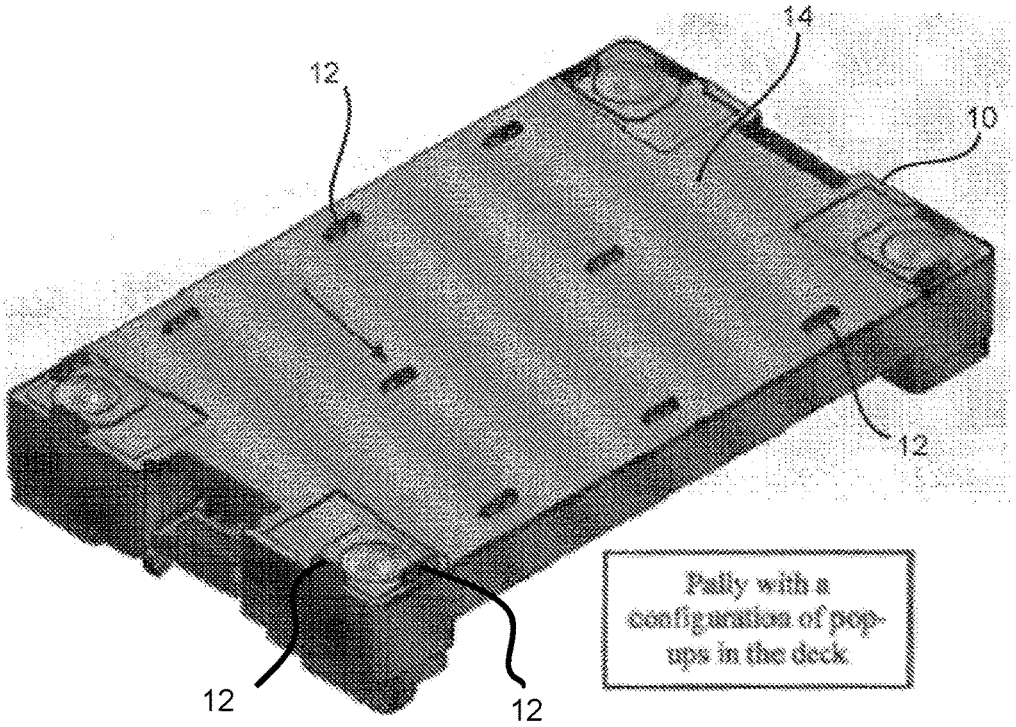
FIG. 1 is a perspective view of a pallet with retractable stops having exposed frictional elements in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention is directed to transport mechanisms, such as pallets, dollies with wheels 30 and other similar structures. The pallets, dollies, etc. are typically formed from a molded plastic or other suitable material. The transport mechanisms include one or more retractable stops where each stop includes a frictional element. The frictional element is positioned on a surface that is exposed when the stop is in a retracted state.

FIG. 1 discloses a generally rectangular pallet 10 having a plurality of retractable stops 12 positioned about an upper support surface 14 of the pallet in accordance with the present invention. Similar configurations can be implemented with dollies or other similar transport structures. The pallet 10 is formed from a molded plastic, or other suitable materials.

The retractable stops 12 are mounted on the pallet 10 for linear movement up and down. As illustrated in FIG. 1, the stops 12 are biased to extend a portion of the stop upward above the upper support surface 14 in the absence of any weighted item (such as a container) being placed on top of the stops 12. In this manner, each stop forms a ridge or encumbrance that prevents an article (again, such as a container) from sliding past the raised stop 14 during transport on the pallet 10.

Figure 2:
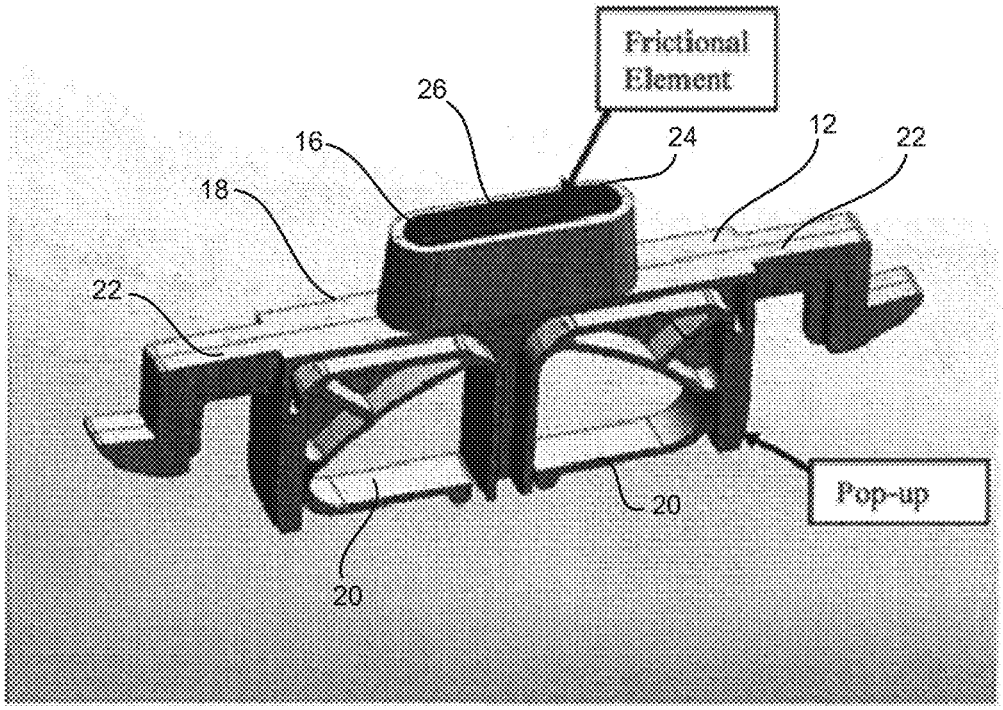
FIG. 2 is a perspective view of a retractable stop with an exposed frictional element.
Figure 3:
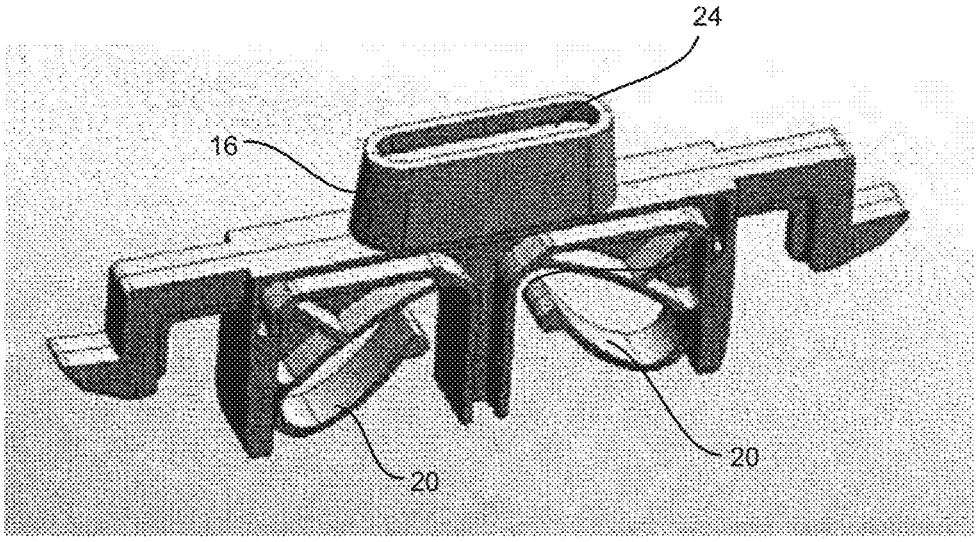
FIG. 3 is a perspective view of just the stop of FIG. 2 with spring elements in a compressed state.
Figure 4:
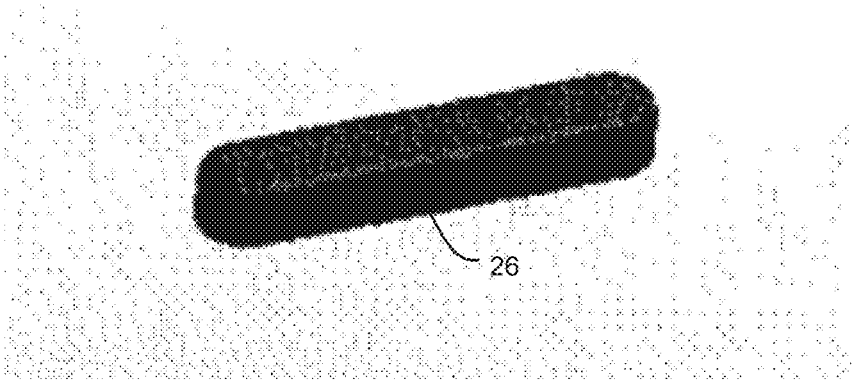
FIG. 4 is a perspective view of just the exposed frictional element of FIG. 2; and, FIG. 5 is a perspective view of a dolly with retractable stops having exposed frictional elements in accordance with the present invention.
Figure 5:
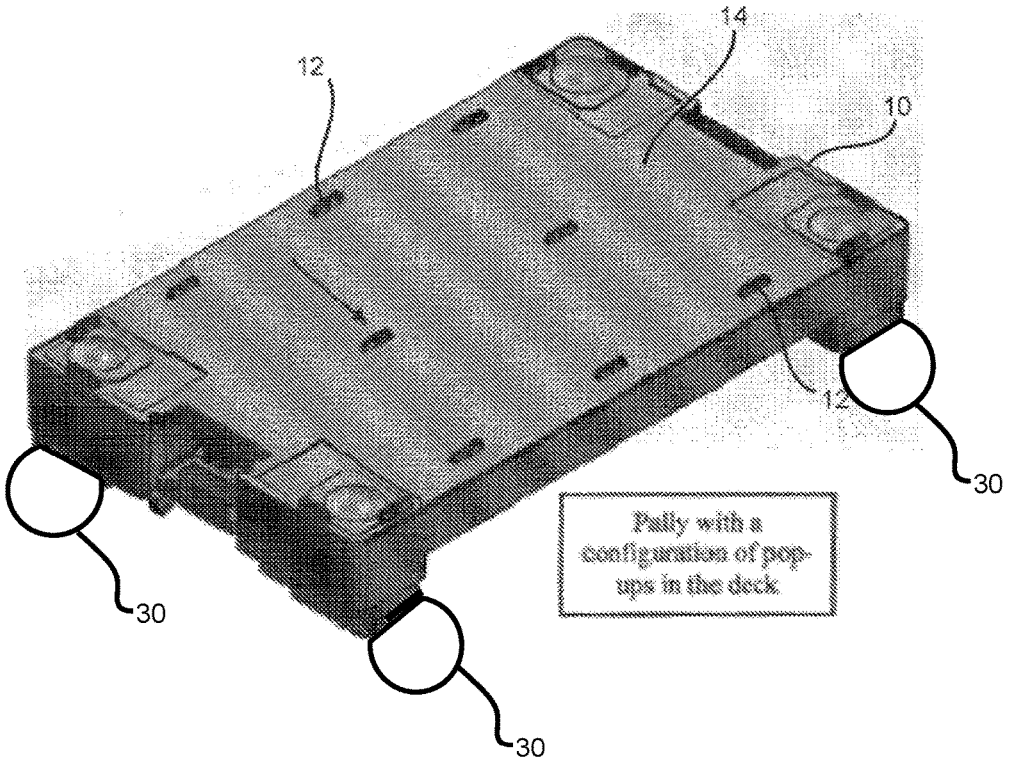

FIG. 2 shows a retractable stop 12 for use in the pallet 10. The retractable stop 12 includes an upper extension 16 that is designed to extend through a corresponding slot in the upper surface 14 of the pallet 10. The upper extension 16 is supported on a base 18 having first and second spring elements 20 (here leaf springs). The spring elements 20 cooperate with ribs or other similar structure in the pallet 10 to enable up and down movement of the upper extension 16. As shown in FIGS. 2 and 3, the spring elements 20 are biased to maintain the upper extension 16 extending above the upper surface 14 of the pallet 10.

When a weight (such as a container) is placed on the upper extension 16, the spring elements 20 flex to a compressed position as shown in FIG. 3, allowing the upper extension 16 to retract downward. After removal of the weight, the spring elements will resume their normal or relaxed shape (shown in FIG. 2), moving the upper extension 16 back above the upper surface 14 of the pallet 10. The base 18 includes two wing portions 22 positioned to contact a lower or opposing side of the upper surface 14.

As illustrated in FIG. 3, the upper extension 16 includes a shallow oval shaped depression 24 with an upper lip surrounding the depression 24. A frictional element 26 is secured to the upper extension 16 in the depression 24.

The stop 12 can be formed from plastic or other suitable material. The frictional element 26 can be rubber, cork or other suitable material that will create friction between the material and articles placed thereon. The frictional element 26 can be added to the depression 24 of the retractable stop 12 in a secondary operation (e.g., a hammered in rubber plug). Alternatively, the frictional element 26 can be molded in to the stop, either by over molding (placing the element into the mold and injecting material onto it) or two-shot or multi-shot molding (injecting two different material into the same mold). It may also be possible to otherwise secure the frictional element using an adhesive or screws or other fasteners.

The frictional element 26, by its positioning at the top of the stop, is thus exposed when the remainder of the stop is partially or completely retracted. That is, the frictional element 26 will be slightly above or flush with the upper surface 14 of the pallet such that it can interact with any container or other article placed on top of the stop 12.

While leaf springs are shown, other spring elements such as coiled metal springs can be used.

Many modifications and variations of the present invention are possible in light of the above teachings. It is, therefore, to be understood within the scope of the appended claims the invention may be protected otherwise than as specifically described.

We claim:

1. A transport structure comprising:

a flat upper support surface for transporting an item, the flat support surface having a first slot;

a first retractable stop mounted to the transport structure, the first retractable stop having an upper extension and a base portion, the first retractable stop biased to maintain the upper extension through the first slot and above the support surface in the absence of a weight, wherein the first retractable stop includes a first leaf spring and a separate second leaf spring which can flex to a compressed position when a weight is applied to the upper extension, the first retractable stop including a first wing extending outward from a first side of the upper extension and a second wing extending outward from a second side of the upper extension; wherein the first leaf spring is positioned under the first wing and the second leaf spring is positioned under the second wing; wherein the first wing and second wing contact a lower side of the upper support surface when the upper extension extends above the upper surface; and, a first frictional element secured to the upper extension of the first retractable stop.

2. The transport structure of claim 1 wherein the transport structure is a pallet.

3. The transport structure of claim 1 wherein the transport structure is a dolly.

4. The transport structure of claim 1 wherein the first retractable stop is formed from plastic.

5. The transport structure of claim 1 wherein the first frictional element is formed from rubber.

6. The transport structure of claim 1 wherein the first frictional element is formed from cork.

7. The transport structure of claim 1 wherein the upper extension has an elongated oval cross-sectional shape.

8. The transport structure of claim 1 wherein the upper extension includes a depression for receiving the first frictional element.

9. The transport structure of claim 1 wherein the frictional element is molded in the retractable stop.

10. The transport structure of claim 7 wherein the base portion is wider than the upper extension.

11. A transport item comprising:

a flat upper support surface for transporting items having a plurality of slots;

a plurality of retractable stops positioned about the support surface wherein each of the plurality of retractable stops is biased to maintain an upper extension above the support surface through one of the plurality of slots in the absence of a weight and wherein each stop includes a first leaf spring and a separate second leaf spring which can flex to a compressed position when a weight is applied to the stop, and includes a frictional element secured to a portion of the retractable stop, wherein each stop includes a first wing and a second wing which contact a lower side of the upper support surface when the upper extension is positioned above the upper surface, and wherein the first leaf spring is positioned under the first wing and the second leaf spring is positioned under the second wing.

12. The transport structure of claim 11 wherein the transport item is a pallet.

13. The transport structure of claim 11 wherein the transport item is a dolly.

14. The transport structure of claim 11 wherein each of the retractable stops is formed from plastic.

15. The transport structure of claim 11 wherein each of the frictional elements is formed from rubber.

16. The transport structure of claim 11 wherein each of the frictional elements is formed from cork.

17. The transport structure of claim 11 wherein each upper extension of each of the retractable stops includes a depression for receiving the frictional element.

18. A transport structure comprising:

an upper support surface for transporting an item having a first slot;

a first retractable stop having a base portion and an upper extension formed from plastic mounted to the transport structure so that the upper extension is extendable through the first slot wherein the first retractable stop includes a first spring element in the base portion and a second spring element in the base portion and wherein the first spring element is a first leaf spring and the second spring element is a separate second leaf spring, wherein the first retractable stop can flex to a compressed position when a weight is applied, wherein the first retractable stop includes a first wing and a second wing which contact a lower side of the upper support surface when the upper extension extends through the first slot, and wherein the first leaf spring is positioned under the first wing and the second leaf spring is positioned under the second wing; and, a first frictional element secured to a portion of the upper extension of the first retractable stop.

* * * * *